United States Patent [19]

Rubiano

[11] Patent Number: 5,072,475

[45] Date of Patent: Dec. 17, 1991

[54] POLISHING PAD CLEANING APPARATUS

[76] Inventor: Alfred Rubiano, 3504 Bergenline Ave., Union City, N.J. 07087

[21] Appl. No.: 559,674

[22] Filed: Jul. 23, 1990

[51] Int. Cl.[5] ..... B08B 11/00

[52] U.S. Cl. ..... 15/3; 15/24; 15/93.1; 29/81.05

[58] Field of Search ..... 15/3, 93.1, 236.1, 38, 15/344, 387; 29/81.05, 81.11

[56] References Cited

U.S. PATENT DOCUMENTS 518,352 4/1894 Nightingale ..... 15/93.1
992,175 5/1911 Dexter ..... 15/93.1
2,354,898 8/1944 Wiksten ..... 15/93.1
4,121,313 10/1978 Mayer ..... 15/3

*Primary Examiner*—Edward L. Roberts
*Attorney, Agent, or Firm*—Leon Gilden

[57] ABSTRACT

An apparatus including a pneumatic gun member, including a trigger to selectively direct pressurized air into contact with teeth members mounted circumferentially about a support disk. The teeth members, upon rotation, are directed against a cleaning pad to effect dislodgement and pneumatic removal of debris such as polishing compound and the like formed about a surface of the pad.

2 Claims, 4 Drawing Sheets

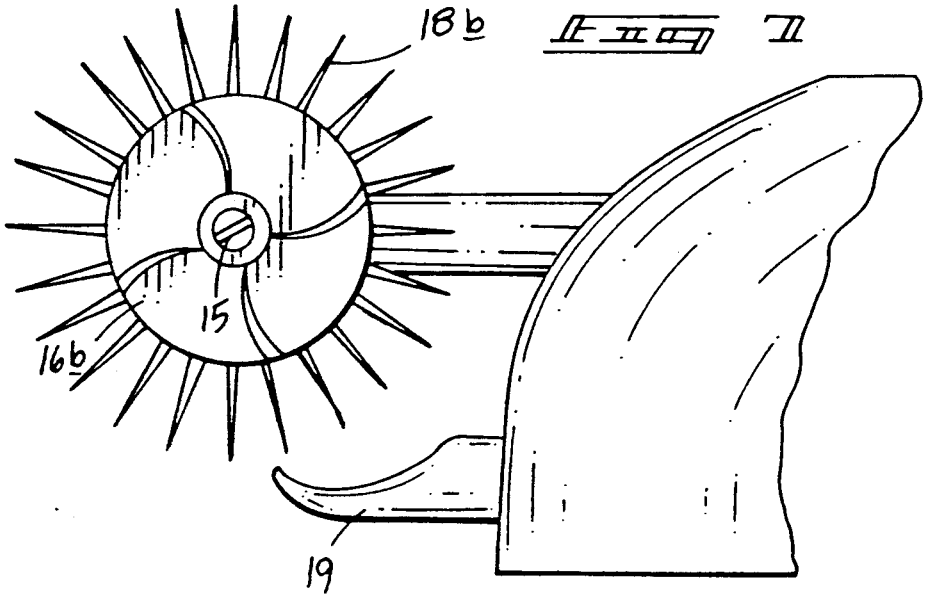
Fig 7
Fig 8
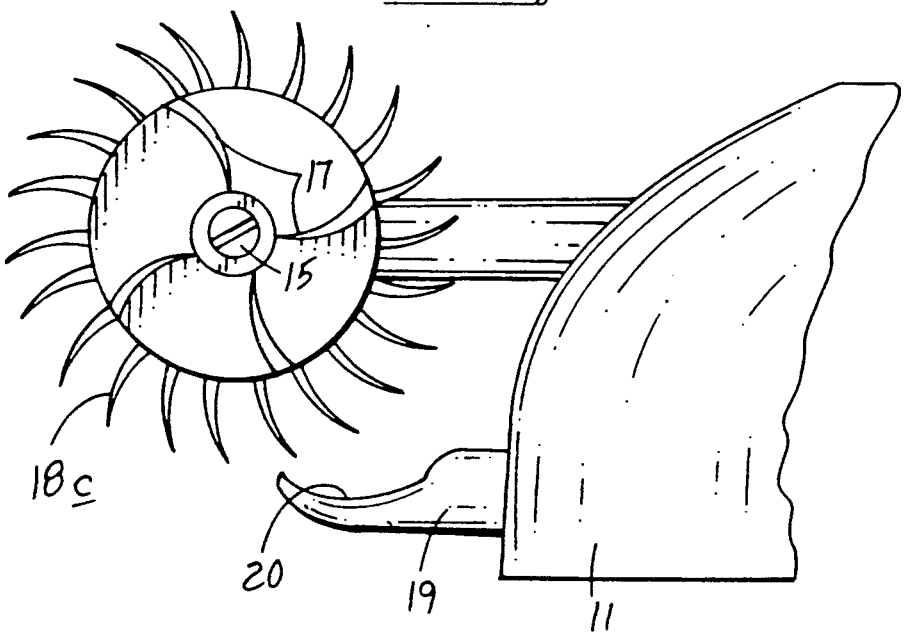

POLISHING PAD CLEANING APPARATUS

BACKGROUND OF THE INVENTION

1. Field of the Invention

The field of invention relates to cleaning apparatus, and more particularly pertains to a new and improved polishing pad cleaning apparatus wherein the same effects dislodgement of various particles adherably formed about a surface of a cleaning pad.

2. Description of the Prior Art

Cleaning pads, and particularly lambs wool type cleaning pads, are conventionally utilized to effect a final polishing and buffing of exterior painted surfaces, such as utilized conventionally with automobiles. Such cleaning pads subsequently and frequently are rendered less effective and efficient by polishing compound being formed and layered about an exterior surface of the pad. The instant invention attempts to overcome deficiencies of the prior art by utilizing a pneumatically rotated toothed cleaning disk to effect dislodgement of the polishing material and permit subsequent pneumatic removal of the cleaning material from an associated pad. Prior art cleaning apparatus is exemplified by U.S. Pat. No. 4,534,080 to Young, et al. wherein a rotatably directed rod is mounted to a power driven tool such as a drill, with multi-strand wire cables extending orthogonally relative to the rod to effect cleaning of an interior chimney cavity.

U.S. Pat. No. 4,302,122 to Oya utilizes a brush rotatably driven by pneumatic pressure, wherein the brush is mounted to a hub and the hub is driven by a pneumatic air supply.

U.S. Pat. No. 3,813,720 to Sylvie provides an electric motor in operative association with a brush to rotatably direct the brush for cleaning purposes such as in a shoe polishing scenario.

U.S. Pat. No. 3,368,635 to Herman sets forth a rotary driven brush utilizing an electric motor and a drive belt system to rotatably drive the brush arrangement.

U.S. Pat. No. 4,238,866 to Taylor sets forth a rain gutter cleaning device wherein a rotatably driven hub includes a plurality of flexible lines directed orthogonally relative to an annular side wall of the hub to effect cleaning of a gutter of a conventional downspout arrangement.

As such, it may be appreciated that there continues to be a need for a new and improved polishing rod cleaning apparatus which addresses both the problems of ease of use as well as effectiveness in construction and in this respect, the present invention substantially fulfills this need.

SUMMARY OF THE INVENTION

In view of the foregoing disadvantages inherent in the known types of cleaning apparatus now present in the prior art, the present invention provides a polishing pad cleaning apparatus wherein the same utilizes a pneumatically directed toothed disk to effect cleaning of a polishing pad. As such, the general purpose of the present invention, which will be described subsequently in greater detail, is to provide a new and improved polishing pad cleaning apparatus which has all the advantages of the prior art cleaning apparatus and none of the disadvantages.

To attain this, the present invention provides an apparatus including a pneumatic gun member, including a trigger to selectively direct pressurized air into contact with teeth members mounted circumferentially about a support disk. The teeth members, upon rotation, are directed against a cleaning pad to effect dislodgement and pneumatic removal of debris such as polishing compound and the like formed about a surface of the pad.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved polishing pad cleaning apparatus which has all the advantages of the prior art cleaning apparatus and none of the disadvantages.

It is another object of the present invention to provide a new and improved polishing pad cleaning apparatus which may be easily and efficiently manufactured and marketed.

It is a further object of the present invention to provide a new and improved polishing pad cleaning apparatus which is of a durable and reliable construction.

An even further object of the present invention is to provide a new and improved polishing pad cleaning apparatus which is susceptible of a low cost of manufacture with regard to both materials and labor, and which accordingly is then susceptible of low prices of sale to the consuming public, thereby making such polishing pad cleaning apparatus economically available to the buying public.

Still yet another object of the present invention is to provide a new and improved polishing pad cleaning apparatus which provides in the apparatuses and methods of the prior art some of the advantages thereof, while simultaneously overcoming some of the disadvantages normally associated therewith.

Still another object of the present invention is to provide a new and improved polishing pad cleaning apparatus wherein the same conveniently effects dislodgement of debris from a polishing pad and subsequently effects pneumatic removal of such debris.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an orthographic side veiw, taken in elevation, of the instant invention utilizing a further disk including elongate wire elements.

FIG. 8 is an orthographic side view, taken in elevation, utilizing a yet further disk including concave arcuate cleaning wires.

DESCRIPTION OF THE PREFERRED EMBODIMENT

Figure 1:
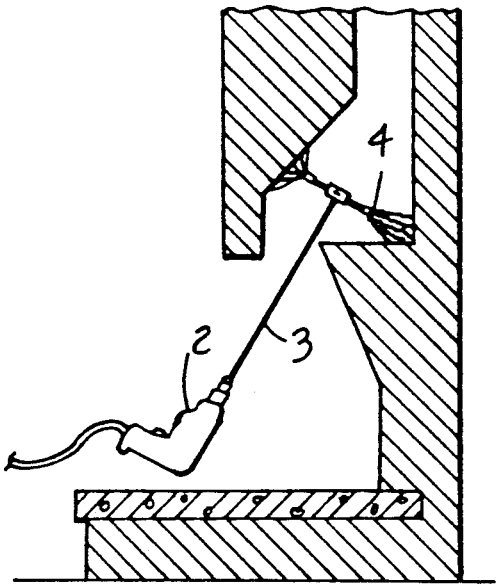
Fig 1 PRIOR ART
FIG. 1 is an orthographic veiw of a prior art cleaning apparatus in use within a chimney flue.

With reference now to the drawings, and in particular to FIGS. 1 to 8 thereof, a new and improved polishing pad cleaning apparatus embodying the principles and concepts of the present invention and generally designated by the reference numeral 10 will be described.

Figure 2:
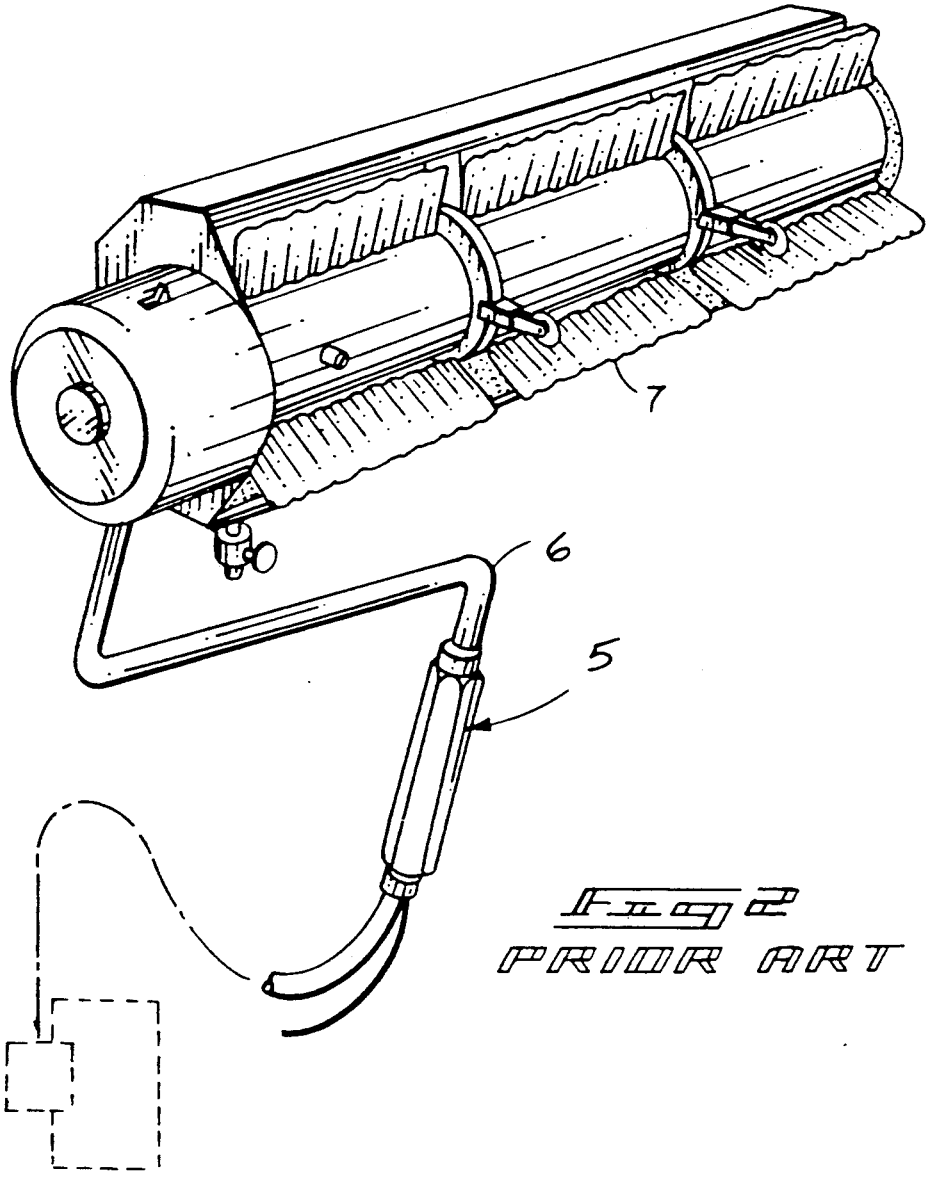
Fig 2 PRIOR ART
FIG. 2 is an isometric illustration of a further prior art rotary cleaning brush apparatus.
Figure 3:
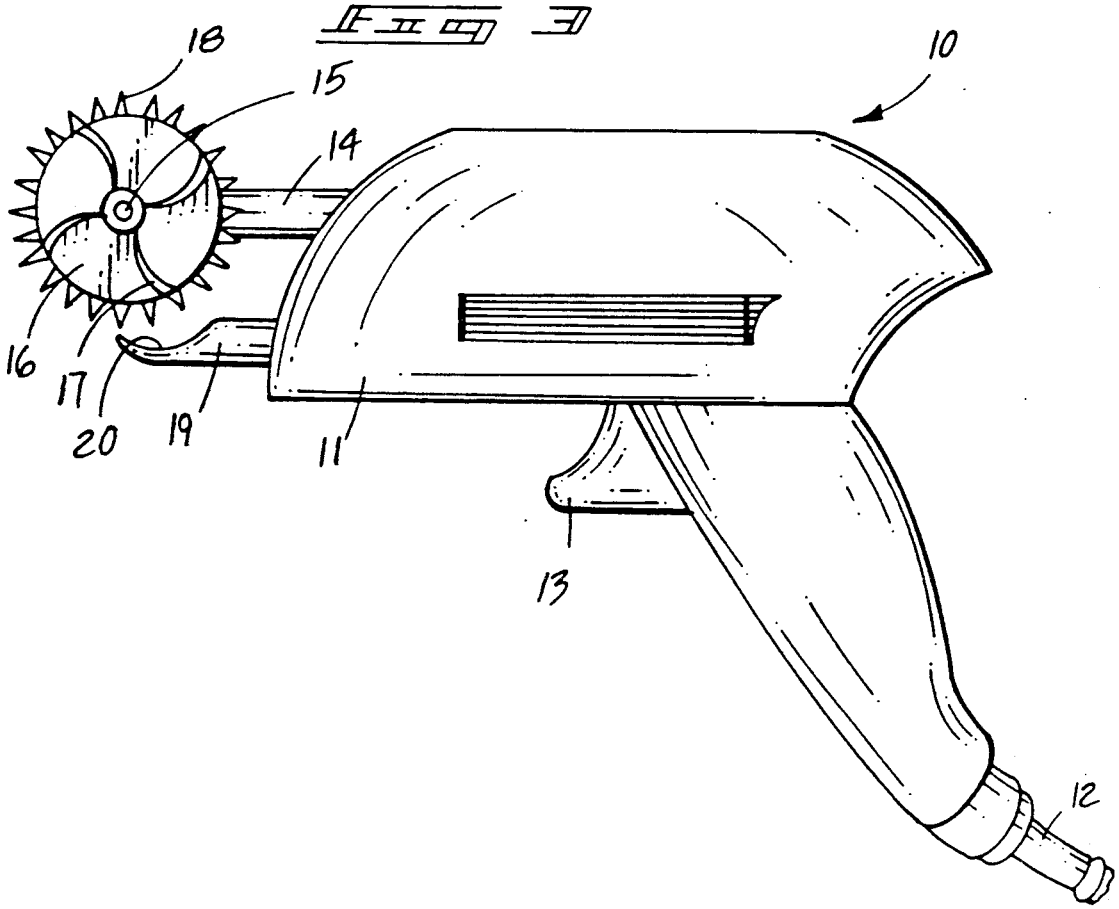
FIG. 3 is an orthographic side view, taken in elevation, of the instant invention.

FIG. 1 illustrates a prior art cleaning apparatus 1 wherein a drill member 2 mounts a rod 3, wherein an upper terminal end of the rod 3 secures a series of orthogonally mounted brushes 4 for cleaning an interior surface of the chimney flue as illustrated. FIG. 2 illustrates a rotary brush member 7 mounted at a hub, wherein the hub is rotatably driven to effect rotary motion of the brush by a pneumatic conduit 6 to define the prior art cleaning apparatus 5.

More specifically, the polishing pad cleaning apparatus 10 of the instant invention essentially comprises a pneumatic gun member 11 including a housing, with a pneumatic hose 12 coupled thereto, with a trigger 13 selectively effecting pressurized pneumatic air to be directed through a pneumatic conduit 19. A support shaft 14 spaced from and parallel to a pneumatic conduit 19 includes a support disk 16, with an axle 15 directed orthogonally relative to the support shaft 14 rotatably mounting the support disk thereon. The support disk 16 includes a continuous array of teeth members 18 that are circumferentially projecting and integrally mounted about the peripheral side wall of the disk 16. Helical vanes 17 are mounted to an end surface of the disk 16 and radially project from the axle 15 to the circumferential edge defined by the disk 16. The pneumatic conduit 19 is positioned to underline the disk 16, with a forward end of the pneumatic conduit 19 positioned adjacent the diametrical center of the disk 16. The pneumatic conduit 19 includes a concave outlet 20 in confronting relationship relative to the teeth 18, whereupon pneumatic pressure directed from the pneumatic conduit 19 effects rotation of the disk 16 upon the pneumatic pressure impacting the teeth 18 and the helical vanes 17.

Figure 4:
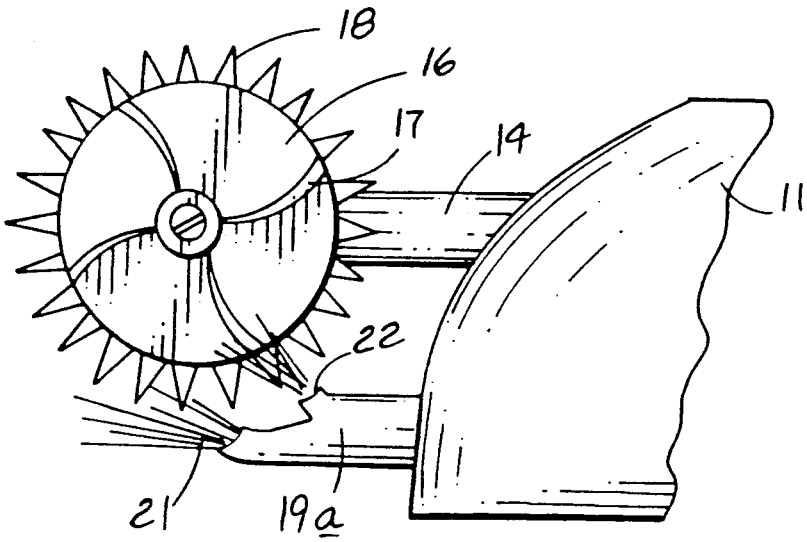
FIG. 4 is an orthographic side veiw, taken in elevation, of a modified pneumatic conduit utilized by the instant invention.
Figure 5:
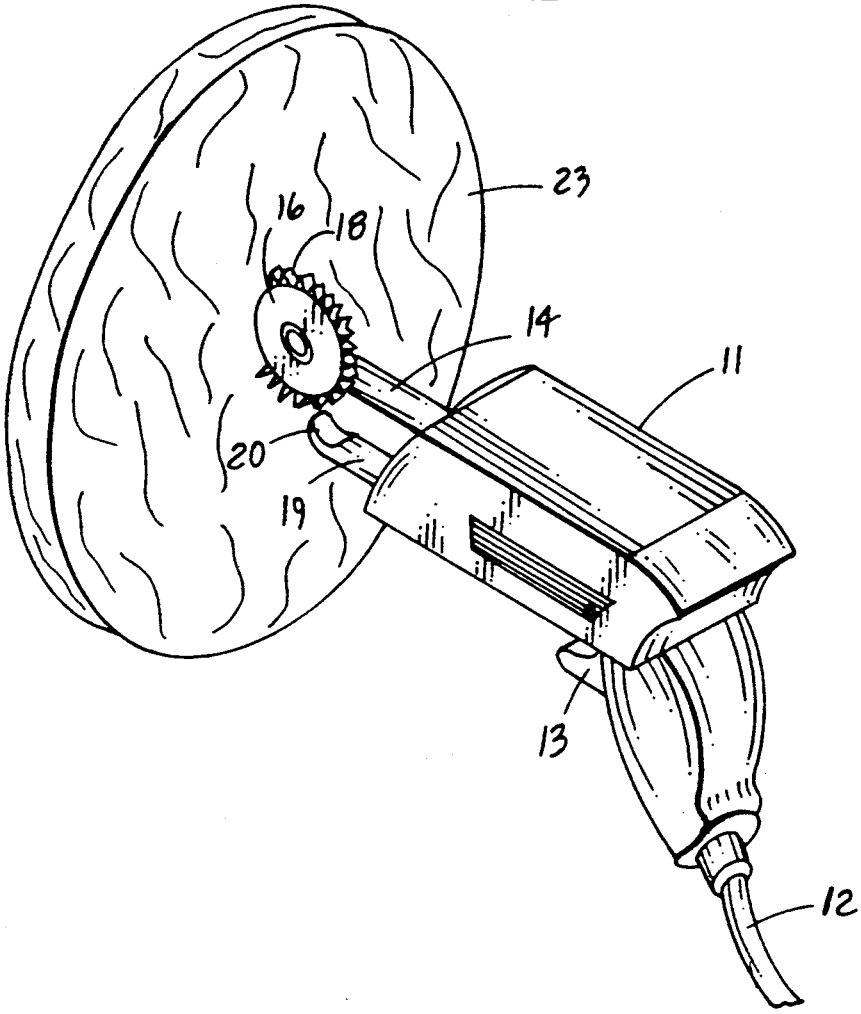
FIG. 5 is an isometric illustration of the instant invention in use.
Figure 6:
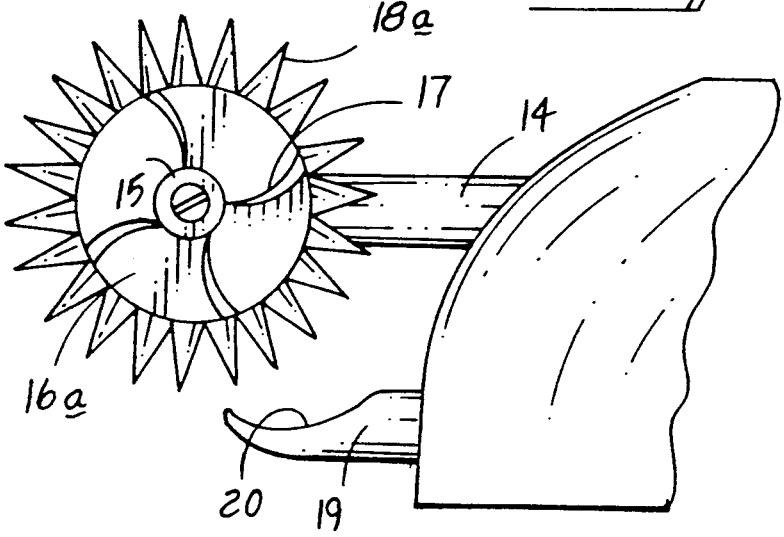
FIG. 6 is an orthographic side view of the instant invention utilizing elongate cleaning spikes.

FIG. 4 illustrates a modified pneumatic conduit 19*a*, including a first pneumatic outlet 20 oriented tangentially to the disk 16 and in confronting relationship relative to the teeth 18 to effect rotation and impact of pneumatic pressure from the conduit 21, with a second pneumatic outlet 22 directed at the vanes 17. In use, a lambs wool pad 23 is fixedly mounted and the pneumatic pressure actuated by use of the trigger 13 to effect pressurized air typically in the order of sixty pounds or greater to effect rotation of the disk 16, whereupon the teeth members 18 are imbedded within the pad 23 to dislodge various debris therewithin, whereupon the pneumatic pressure directed from the pneumatic conduit 19 displaces such debris from about the pad 23. FIG. 6 illustrates the use of elongate spikes 18*a* as modified teeth mounted about the disk 16, with FIG. 7 illustrating the use of elongate wire elements 18*b* for use as the teeth. The FIG. 8 illustrates the use of arcuate wire elements 18*c*, with the concave surface of the arcuate wire elements 18*c* oriented towards the outlet of the pneumatic conduit 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illrustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A polishing pad cleaning apparatus comprising, a pneumatic gun housing, the housing including a pneumatic hose, the pneumatic hose arranged for directing pressurized air into the housing, and a pneumatic conduit positioned exteriorly of the housing for receiving and directing pressurized air from the pneumatic gun housing, and a switch member mounted to the housing to effect selective pressurizing of the pneumatic conduit, and a support shaft mounted to the housing overlying the pneumatic conduit, the support shaft including a support axle mounted orthogonally through the support shaft, the support axle mounting a support disk thereon, the support disk including a continuous array of teeth members, the teeth members directed exteriorly and radially of the support disk projecting exteriorly of the support disk an annular perimeter thereof, and the pneumatic conduit including an outlet, the outlet positioned underlying and adjacent to the teeth members directing said pressurized air against said teeth members to effect rotation of the teeth members upon pressurized air being directed through the pneumatic conduit, and wherein the outlet extends to a position adjacent the axle of the disk, and including a further pneumatic outlet directed through the pneumatic conduit adjacent the pneumatic outlet, and a series of helical vanes mounted about an end surface of the disk radially arranged about the disk, with the further pneumatic outlet oriented towards the helical vanes.

2. An apparatus as set forth in claim 1 wherein the teeth members include arcuate wire elements, the arcuate wire elements including a concave surface oriented to overlie the outlet and further outlet.

* * * * *